United States Patent [19]

Kennedy

[11] 4,026,041

[45] May 31, 1977

[54] TWO-DIMENSIONAL DRAWING BOARD MANIKIN

[75] Inventor: Kenneth W. Kennedy, Yellow Springs, Ohio

[73] Assignee: The United States of America as represented by the Secretary of the Air Force, Washington, D.C.

[22] Filed: Apr. 28, 1976

[21] Appl. No.: 681,018

[52] U.S. Cl. ..... 35/26; 33/174 B
[51] Int. Cl.² ..... B43L 13/22
[58] Field of Search ..... 35/17, 26, 28, 29 D; 33/174 B

[56] References Cited

UNITED STATES PATENTS

| | | | |
|---|---|---|---|
| 1,974,442 | 9/1934 | Baldwin | 33/174 B |
| 2,118,092 | 5/1938 | Loeffel | 35/28 |
| 2,507,768 | 5/1950 | Champagne | 35/29 D |

FOREIGN PATENTS OR APPLICATIONS

| | | | |
|---|---|---|---|
| 1,575,684 | 6/1969 | France | 35/17 |

OTHER PUBLICATIONS

E. J. Moulis, "Articulated Manikin Templates," Western Electric Tech. Dig. No. 15, July 1969, pp. 31, 32.

*Primary Examiner*—Harland S. Skogquist
*Attorney, Agent, or Firm*—Joseph E. Rusz; Richard J. Killoren

[57] ABSTRACT

A two dimensional drawing board manikin adapted to lay flat on either side and having a head, neck and three part torso which are pivotable with respect to each other with the movement of the parts being limited by limit motion stops to anatomically correct positions. Removable limbs are attached to the torso which may be positioned to represent various anatomically correct positions. Eye, ear, carotid sinus and aortic valve positioning holes and slots are provided. Alignment and positioning holes are provided around the various pivots between the parts.

6 Claims, 19 Drawing Figures

TWO-DIMENSIONAL DRAWING BOARD MANIKIN

RIGHTS OF THE GOVERNMENT

The invention described herein may be manufactured and used by or for the Government of the United States for all governmental purposes without the payment of any royalty.

BACKGROUND OF THE INVENTION

This invention relates to a two dimensional drawing board manikin for use as a design tool or aid.

Prior art drawing board manikins suffer from the problem of instability and are not easy to use. These drawing board manikins do not give useful body contours which are anatomically correct. Also, the prior art manikins are capable of assuming positions which are not anatomically correct. They cannot simultate all body movements in a two dimensional system and cannot assume all positions that the body can assume in the two dimensional system.

BRIEF SUMMARY OF THE INVENTION

According to this invention, a drawing board manikin is provided which provides guide slots and pivots located to give representative anatomically correct body profiles in two dimensions for various positions the body can assume. Limit motion stops are provided to limit the torso and head to anatomically correct positions. Due to the great leverage of the arms and legs, stops are not used to prevent movement of the elbow and knee to anatomically incorrect positions. Pin holes are provided to position to arms and legs at the extremes of normal movement. However, stops are provided to limit the forward movement of the arms and backward movement of the legs to anatomically correct limits.

IN THE DRAWINGS

DETAILED DESCRIPTION OF THE INVENTION

Figure 1:
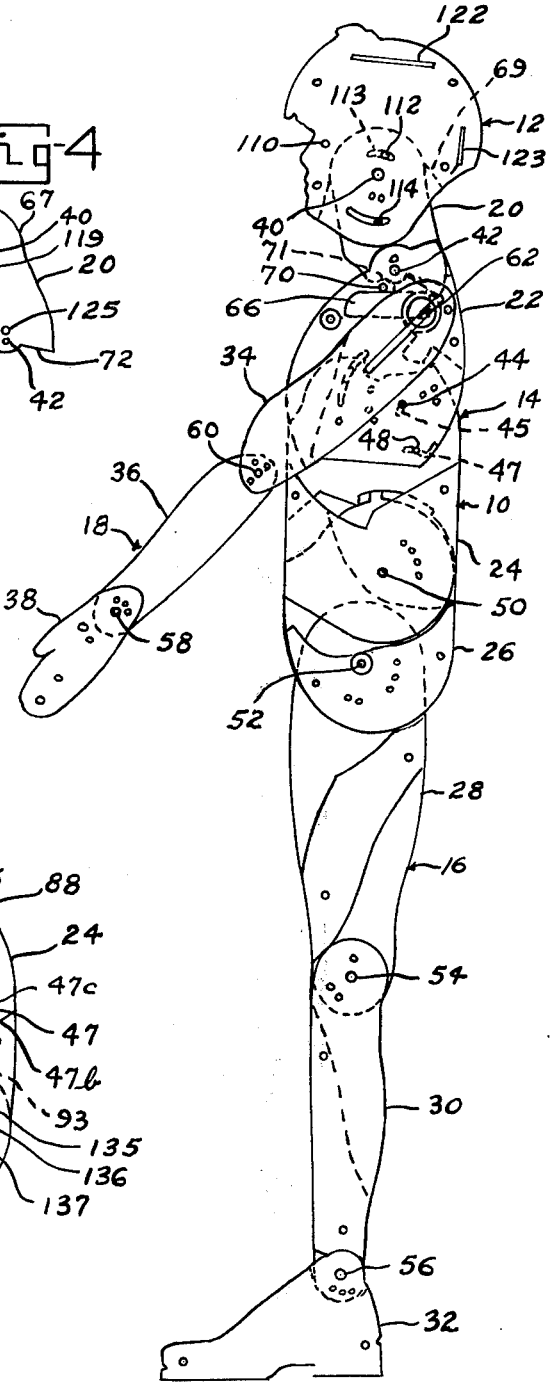
FIG. 1 is a top plan view of the device of the invention in its substantially erect position.
Figure 2:
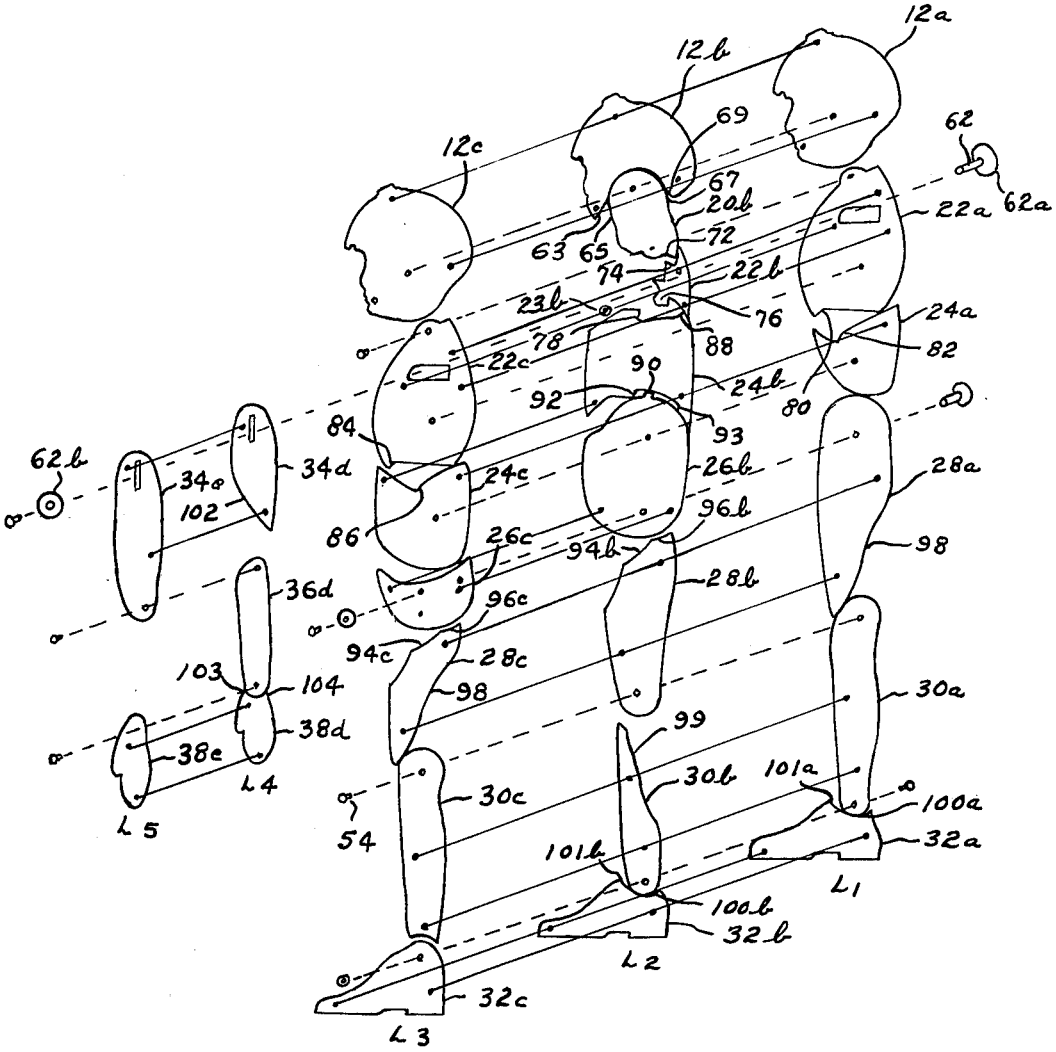
FIG. 2 is a partially schematic exploded view of the device of FIG. 1.

Reference is now made to FIG. 1 of the drawing which shows a drawing board manikin 10 which has the head 12, torso 14 and leg 16 constructed of three layers of parts indicated generally as $L_1$, $L_2$ and $L_3$ in the exploded view of FIG. 2, with an arm 18 consisting of two layers indicated generally as $L_4$ and $L_5$ in FIG. 2. The neck member 20 is formed of a single layer shown in layer 2 of FIG. 2.

The solid connecting lines in FIG. 2 indicate bonding points between parts in the three layers and the dotted connecting lines indicate points of rotation. The parts are bonded together with stationary rivets; however, other means could be used if desired.

Figure 3:
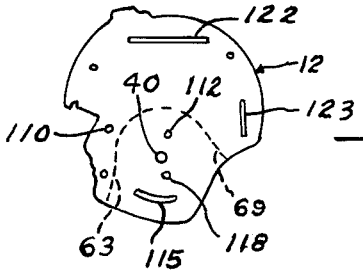
FIG. 3 is a plan view of the head member for the device of FIG. 1.

The head member consists of part **12*a*, 12*b* and 12*c*** in FIG. 2 shown bonded together in FIG. 3.

Figure 4:
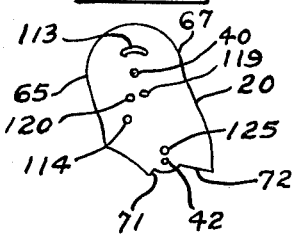
FIG. 4 is a plan view of the neck member for the device. of FIG. 1.

The neck member is made of a single layer **20*b*** shown in FIG. 4.

Figure 5:
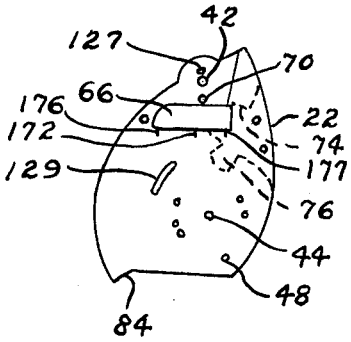
FIG. 5 is a plan view of the upper torso member for the device of FIG. 1.
Figure 6:
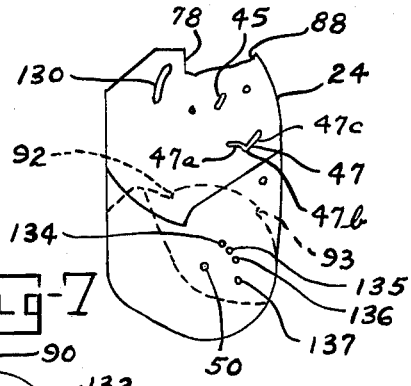
FIG. 6 is a plan view of the middle torso member for the device for FIG. 1.
Figure 7:
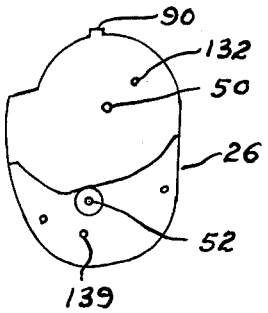
FIG. 7 is a plan view of the lower torso member for the device of FIG. 1.

The torso 14 consists of three sections, the upper torso member 22, shown in FIG. 5, a middle torso member 24, shown in FIG. 6, and a lower torso member 26, shown in FIG. 7.

The upper torso member 22 is made of parts **22*a*, 22*b* and 22*c* and spacer member 23*b* in FIG. 2. The middle torso member 24 is made up of parts 24*a*, 24*b* and 24*c* in FIG. 2. The lower torso member 26 is made up of parts 26*b* and 26*c***.

Figure 8:
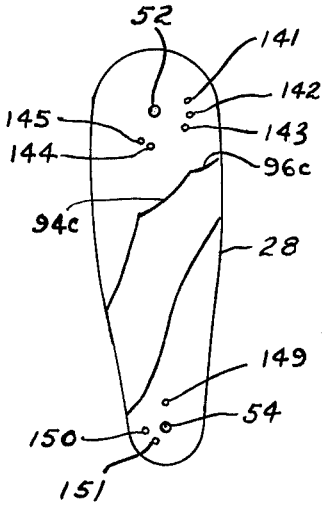
FIG. 8 is a plan view of the upper leg member for the device for FIG. 1.
Figure 9:
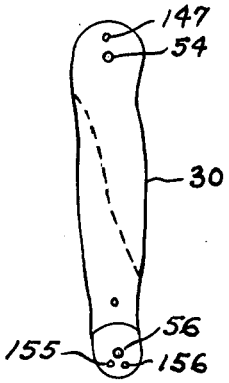
FIG. 9 is a plan view of the lower leg member for the device for FIG. 1.
Figure 10A:
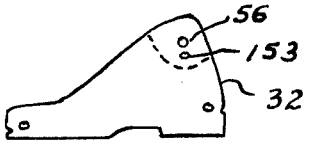
FIG. 10A is a plan view of a foot member with shoe for the device of FIG. 1.
Figure 10B:
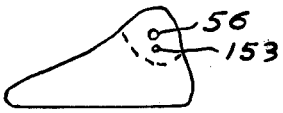
FIG. 10B is a plan view of an alternate bare foot member for the device of FIG. 1.

The lower limb is made up of an upper leg member 28 shown in FIG. 8, a lower leg member 30 shown in FIG. 9, and the foot member 32 shown in FIG. 10A. The upper leg member 28 is made up of parts **28*a*, 28*b* and 28*c* in FIG. 2. The lower leg member 30 is made up of parts 30*a*, 30*b* and 30*c* in FIG. 2. The foot member 32 is made up of parts 32*a*, 32*b* and 32*c*** in FIG. 2. The foot member shown in FIG. 10B may be substituted for the foot member shown in FIG. 10A to represent a foot without a shoe.

Figure 11:
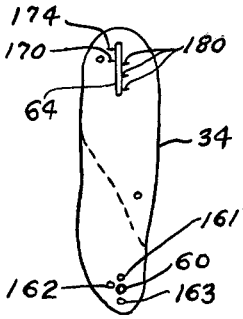
FIG. 11 is a plan view of the upper arm member for the device of FIG. 1.
Figure 12:
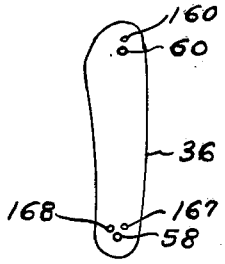
FIG. 12 is a plan view of the lower arm member for the device of FIG. 1.
Figure 13:
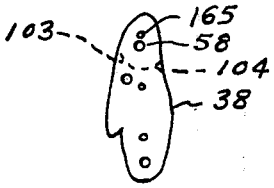
FIG. 13 is a plan view of a hand member for the device of FIG. 1.

The upper limb is made up of an upper arm member 34 shown in FIG. 11, a lower arm member 36 shown in FIG. 12 and a hand member 38 shown in FIG. 13.

The upper arm member is made up of parts **34*d* and 34*e* in FIG. 2. The middle arm member is made of a single member 36*d* in FIG. 2 and the hand member 38 is made up of parts 38*d* and 38*e*** in FIG. 2.

Basic to the design of two-dimensional drawing board manikins is an intimate knowledge of anthropometric variability and human anatomy, with a working knowledge of statistical mathematics and an appreciation for the procedures used by designers and draftsmen. So that the manikin will be representative of a definable using population, i.e., USAF flying officers, American driving population, middle school children, etc., there must be available a body of reliable anthropometric data including the means and standard deviation for body dimensions corresponding to the manikin dimensions. Since anthropometric dimensions are measured on the erect sitting and standing postures, these are the body attitudes that must first be designed. However, since people do not usually operate equipment in the erect posture, a normally slumped posture must be calculated and profiles of both body postures drawn to be compatible with the predetermined percentile values for each of the applicable anthropometric dimensions. The chosen percentile manikin can be designed using that percentile value for all anthropometric dimensions (i.e., Mean value + 1.65X Standard Deviation equals 95th percentile; Mean value — 1.28X Standard Deviation equals 10th percentile, and so on). Other percentile data can be obtained from standard statistical text book tablets. Once a suitable profile is established, it is necessary to decide which centers of body segment rotation to use and how to locate them appropriately within the body segments. Centers of rotation at the ankle, knee, hip, wrist, and elbow are obviously necessary and their location within the segment is rather straight forward. Location of suitable and practical centers of rotation in the torso and neck is much more complex. After investigating suitable torso and neck centers, it was found that the Lumbar 3 and 4 vertebral interspace, Thoracic 8 and 9 vertebral interspace, Cervical 7 — Thoracic 1 vertebral interspace, and the Atlanto-Occipital interspace offered the "best" averages for true-to-life body segment rotations and, at the same time, a practical number of segments for two dimensional manikin design.

The head 12 is connected to the neck member 20 by means of pivot pin 40. This pivot pin is positioned to correspond to the Altanto-occupital joint to represent head and neck movement.

The neck 20 is connected to the upper torso member 22 by means of a pivot pin 42. This pin is positioned to correspond to the cervical 7 and thoracic 1 intervertebral space.

The pivot between the upper torso member 22 and middle torso member 24 must be made to represent the shortening of the upper body when moving from the erect position to the slumped position. A pivot pin 44 in member 22 pivots in slot 45 in member 24. A guide slot 47 in member 24 engages guide pin 48 in member 22. As part 22 moves forward to the slumped position, guide pin 48 moves from the curved portion 47*a* of guide slot 47 which has as its center the upper portion of slot 45, through a transition portion 47*b* to the second curved portion 47*c* which has its center at the lower portion of slot 45. Movement of pin 48 through the transition portion 47*b* acts to move pin 44 from the upper portion of slot 45 to the lower portion of slot 45. The pivot pin 44 is positioned to correspond approximately to the Thoracic 8 and Thoracic 9 intervertebral space.

The middle torso member 24 is connected to the lower torso member 26 by means of pivot pin 50. This pivot pin is positioned to correspond to lumbar 3 and lumbar 4 intervertebral space.

The upper leg member 28 is connected to the lower torso member 26 by means of pivot pin 52 positioned to correspond to the hip joint. The pivot pin 52 is made removable so that different leg members can be used.

The lower leg member 30 is connected to the upper leg member 28 by means of a pivot pin 54. This pivot pin is positioned to correspond to the knee joint.

The foot member 32 is connected to the lower leg member 30 by means of pivot pin 56. This pivot pin is positioned to correspond to the ankle joint.

The hand member 38 is connected to the lower arm member 36 by means of pivot pin 58. This pivot pin is positioned to correspond to the wrist joint.

The lower arm is connected to the upper arm by means of pivot pin 60. This pivot pin is positioned to correspond to the elbow joint.

The upper arm is connected to the upper torso member 22 by means of pivot pin 62. This pin is a removable pin to permit mounting of the arm on either side of the body and to permit the use of different arms to represent different arm lengths. The upper arm has an elongated slot 64 for receiving pin 62. The upper torso member 22 has a movement envelope 66 for receiving pin 62. The pin 62 has large end members 62*a* and 62*b* for retaining pin 62 in slots 64 and 66. The slot 64 and envelope 66 permit simultation of movement of the arm and shoulder.

Link distances between adjacent centers of rotation were made anatomically correct in accordance with the available literature. Ranges of rotation around the pivots are limited by the use of limit motion stops and guidepin slots which are rendered compatible with human capability.

The movement of the head around pivot 40 is limited by forward stop surface 63 on member 12*b* which engages the forward portion 65 of neck member 20. Rearward movement of the head around pivot 40 is limited by rearward stop surface 69 on member 12*b* which engages the back portion 67 of neck member 20.

Movement of the neck around pivot 42 is limited in the forward direction when stop 71 on neck member 20 engages pin 70, shown in FIGS. 1 and 5, on the upper torso member 22. The rearward movement of the neck member 20 around pivot 42 is limited by stop 72 of neck member 20 which engages stop member 74 on member 22*b*.

Movement between the upper torso member 22 and the middle torso member 24 is limited in the forward direction by the engagement of stop 76, on member 22*b*, with stop 78, on member 24*b;* the engagement of stop 80, on member 22*a*, with the stop 82, on member 24*a;* and the engagement of stop 84, on member 22*c*, with stop 86, on member 24*c*. The guide pin 48 in slot 47*c* also acts to limit forward movement around pivot 44. Rearward movement between upper torso member 22 and the middle torso member 24 is limited by engagement of the back surface of stop 76 on member 22*b* with stop 88 on member 24*b*. The guide pin 48 in slot 47*a* also acts to limit rearward movement around pivot 44.

Movement between the middle lower torso member 28 and the middle torso member 26 is limited in the forward and rearward direction by a stop 90 on member 26*b* which engages stops 92 and 93 on member 24*b*.

Stops 94*b* and 94*c* on members 28*b* and 28*c* engage members 26*b* and 26*c* to limit forward movement of the upper leg around pivot pin 52. Stops 96*b* and 96*c* on members 28*b* and 28*c* engage members 26*b* and 26*c* to limit rearward movement of the upper leg around pivot pin 52.

Movement between the upper leg 28 and lower leg 30 is not limited in the forward direction since the great leverage makes it difficult to provide stops that will not break and cause damage to the other parts. Stops 98 on members 28*a* and 28*c* engage the back of leg members 30*a* and 30*c* and stop 99 on member 30*b* engages the back of upper leg member 28*b* to limit the rearward movement of the lower leg around pivot pin 54.

Stops 100*a* and 100*b* on members 32*a* and 32*b* engage members 30*a* and 30*b* to limit rearward movement of the foot member 32. Stops 101*a* and 101*b* on members 32*a* and 32*b* engage members 30*a* and 30*b* to limit forward movement of the foot member 32.

No stops are provided between the upper arm 32 and the upper torso member 22. There are no stops to limit rearward movement around arm pivot pin 60. Stop 102 on member 34*d* engages member 36*d* to limit forward movement around pivot pin 60. Stops 103 and 104 on hand member 38*d* limit the forward and rearward movement of the hand.

Marking holes and slots and positioning holes are positioned to indicate certain available anthropometric data. The position of the eye is indicated by marking hole 110. The position of the ear is indicated by a marking hole 112 in head member 12 with a curved access slot 113 being provided in member 20. The position of the carotid sinus is indicated by marking hole 114 in member 20 with a curved access slot 115 being provided in members 12*a* and 12*c*. A positioning hole 118 is provided on member 12 which may be aligned with hole 119 to indicate the head erect position and with hole 120 to indicate a slumped position. Tangent slots 122 and 123 mark the positions of the top and back of the head within the helmet. A positioning hole 125 in member 20 is aligned with hole 127 in member 22 to indicate the erect neck position.

In the erect body position, the aortic valves are located 3½ inches below suprasternale, in the midline of the thorax and approximately one-third of the distance through the chest, front to back. The aortic valves are tracked using two overlapping curved slots 129 and 130. One slot 129 is of constant radius around pin 44 corresponding to the Thoracic 8–9 vertical interspace as located for the sitting erect torso position or around pin 44 in the upper position in slot 45. The other overlapping curved slot 130 is of constant radius from Thoracic 8–9 in the sitting normally slumped torso position or around pin 44 in the lower position in slot 45. The lengths of the arcs are such that the estimated position of the aortic valves is located in the center of the parts of the arcs that overlap.

A positioning hole 132 in part 26 may be aligned with holes 134, 135, 136 or 137 to indicate the range of movement of the lower back with hole 135 indicating the erect position and hole 136 indicating the slumped position.

A positioning hole 139 in member 26 may be aligned with holes 141, 142, 143, 144 and 145 in member 28 to indicate similar positions of the upper leg member 28. Alignment of hole 144 indicates the normally standing position; hole 145, the hyper-extended thigh.

A positioning hole 147 in member 30 may be aligned with holes 149, 150 and 151 in member 34 to indicate, respectively, 5th and 95th percentile flexion lower leg positions.

Member 32 has a hole 153 which may be aligned with holes 155 and 156 to the range of foot dorsiflexion and plantar flexion.

The hole 160 in member 36 may be aligned with one of the holes 161, 162 and 163 in member 34 to indicate, respectively, lower arm 95th percentile flexion, 5th percentile flexion and full extension.

The hole 165 in member 38 may be aligned with one of the holes 167 or 168 in member 36 to indicate the range of hand positions.

Figure 14:
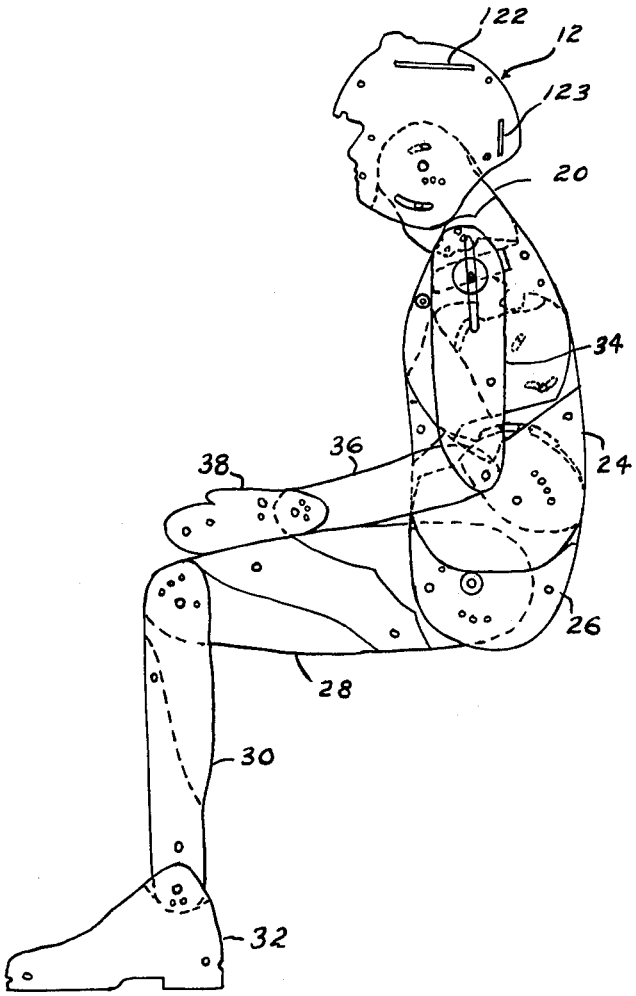
FIG. 14 shows the device of FIG. 1 in a normal sitting position.
Figure 15:
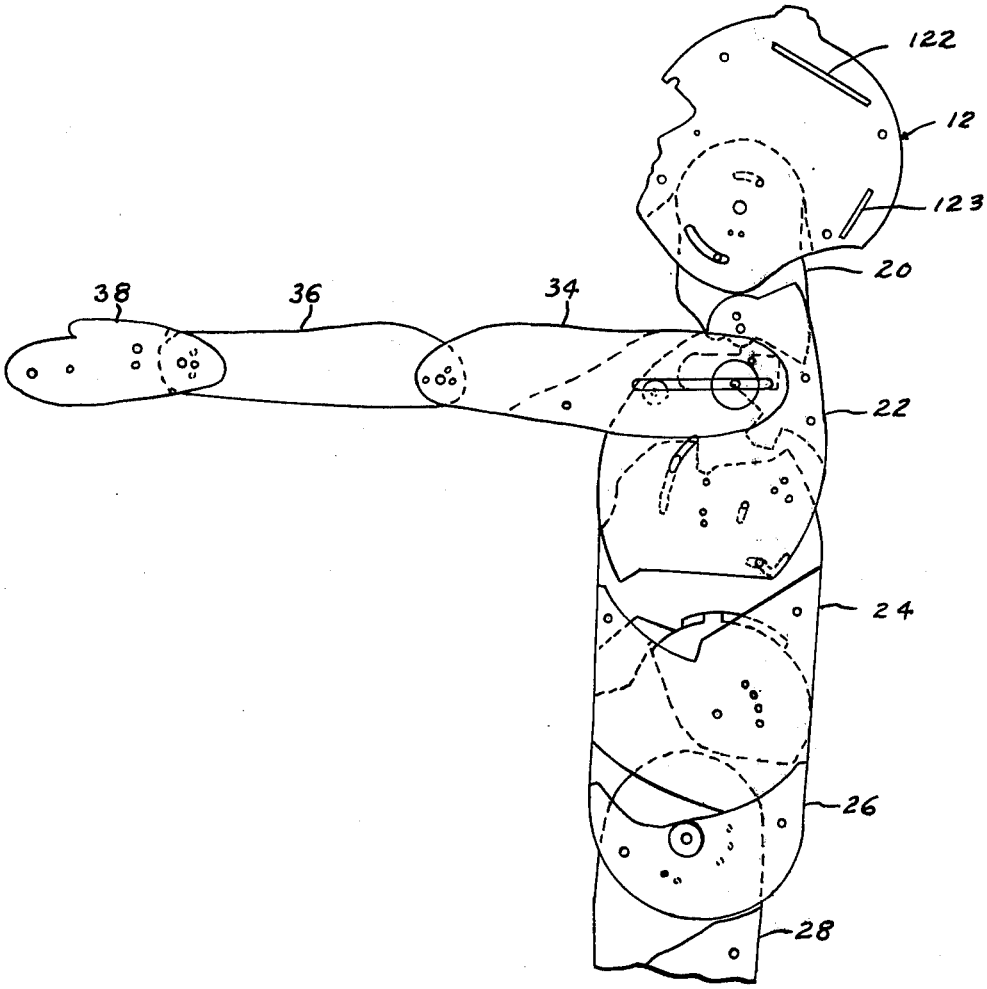
FIG. 15 is a partially cut away view of the device of FIG. 1 with the arm in the normal forward position and with head and neck extended.
Figure 16:
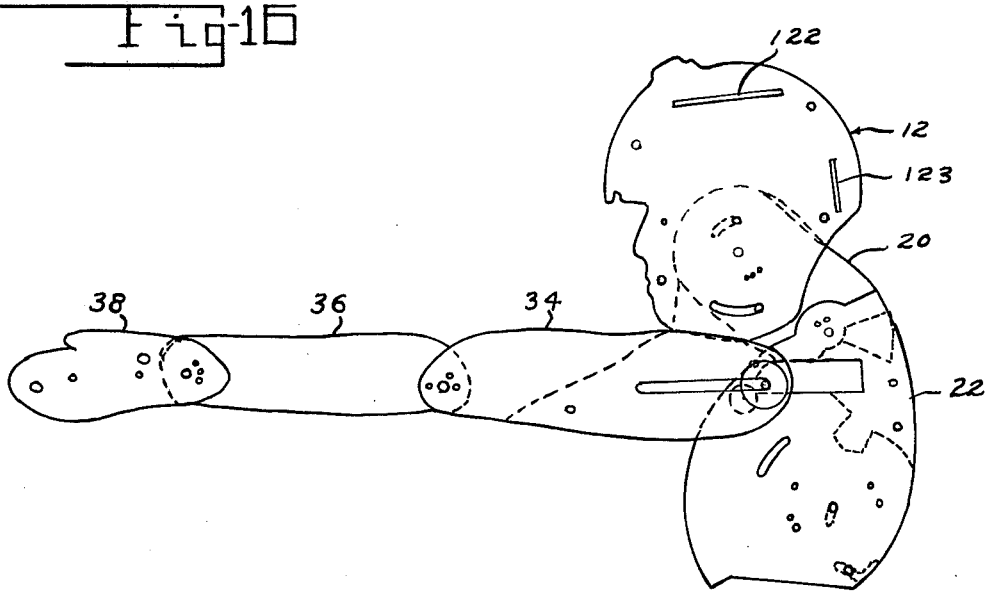
FIG. 16 is a partially cut away view of the device of FIG. 1 with the arm in the extended forward position and with the head thrust forward.
Figure 17:
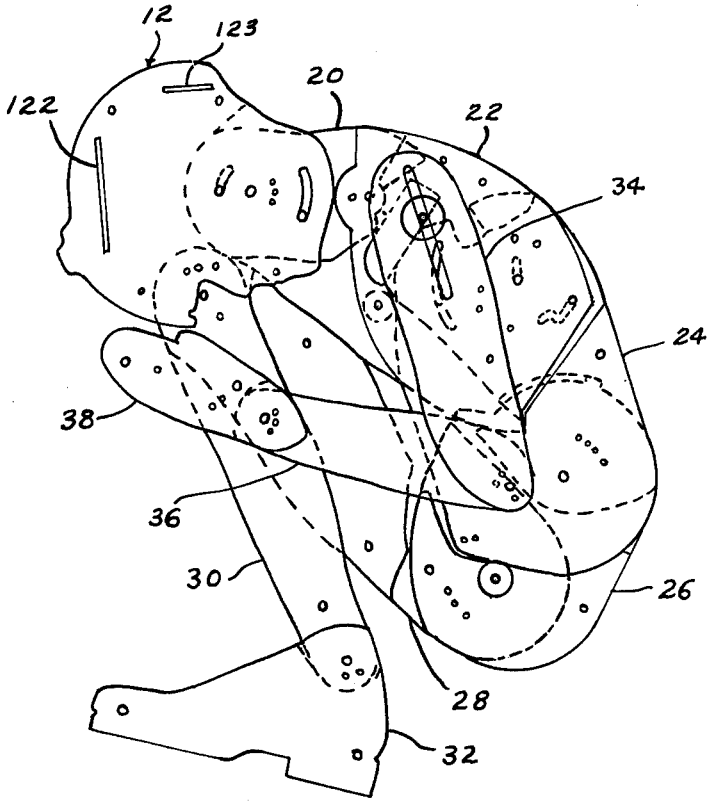
FIG. 17 shows the device of FIG. 1 in the fetal position.

The slot 64 in member 34 has markings 170 which is adapted to be positioned opposite marking 172 adjacent movement envelope 66 to position the arm for normal extension, as shown in FIG. 15. A marking 174 adjacent slot 64 is positioned opposite mark 176 adjacent movement envelope 66 to represent the arm for the fully extended position, as shown in FIG. 16. Marking 177 adjacent envelope 66 indicates normal shoulder position. The markings 180 indicate various arm rest positions in the normal sitting positions, shown in FIG. 14. FIG. 17 shows the manikin positioned in the fetal position.

Figure 18:
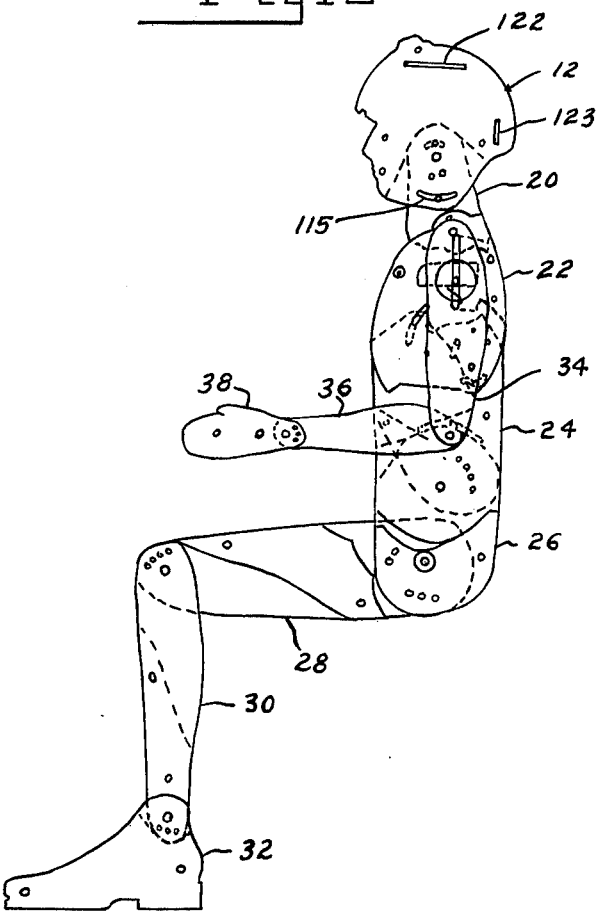
FIG. 18 shows a modification of the device of FIG. 1 constructed to the 5th percentile body size to scale.

The manikin shown in FIGS. 1–17 and described above is for the USAF flying officers 95 percentile. The manikin shown in FIG. 18 is constructed in substantially the same manner as described above and is for the USAF flying officers 5th percentile.

While the manikin has been described as being constructed of three layers, it is to be understood that it could be constructed by milling to provide the three levels.

The arm may be attached to either the left or right side of the manikin. Attaching the arm to the left side of the manikin allows the manikin to be completely flat on the right side. Attaching the arm to the right side allows the left side to be flat. This attribute makes for stability on the drawing board.

The arm and leg are detachable from the torso. Alternate limbs can be used to represent the smallest and largest practical limb sizes found on a given percentile torso — limited, for practicality, to a maximum of 99th percentile and a minimum of 1st percentile. These alternative size limbs are sized using appropriate multiples of Standard Errors added to and substracted from the percentile limb used for the basic manikin.

The ½ scale manikins constructed have been made of ⅛ inch thick clear plastic sheet material. Also, ¼, ⅛, and 1/10 scale manikins were constructed using 1/16 inch thick clear plastic. Alternative thicknesses may be used for these and other scale manikins. Plexiglass, Lexan or other clear plastic material can be used for making the manikins. For some applications, translucent or opaque materials could be used.

There is thus provided a two-dimensional drawing board manikin which can lay flat on either side and which can be made to assume substantially correct anatomical positions.

I claim:

1. A two dimensional drawing board manikin, comprising: a head member; a neck member pivotably connected to said head member; an upper torso member pivotably connected to said neck member; a middle torso member pivotably connected to said upper torso member; a lower torso member pivotably connected to said middle torso member; means for restricting movement of the head, neck, upper torso member, middle torso member and lower torso member to anatomically correct positions; an upper leg member pivotably connected to said lower torso member at a position approximately corresponding to the hip joint; a lower leg member pivotably connected to said upper leg member at a position approximately corresponding to the knee joint; a foot member connected to said lower leg member at a position approximately corresponding to the ankle joint; an upper arm member movably and pivotably connected to the upper torso member at positions corresponding to positions which may be assumed by the shoulder joint; a lower arm member pivotably connected to said upper arm member at a position approximately corresponding to the elbow joint; a hand member pivotably connected to said lower arm member at a position approximately corresponding to the wrist joint; said manikin including means, on said head member, said torso members and said leg members, for providing two opposite substantially flat surfaces adapted to lay flat on a drawing board.

2. The device as recited in claim 1 wherein the head to neck pivot is located at a position approximately corresponding to the atlanto-occipital interspace; the neck to upper torso pivot is located at a position approximately corresponding to the cervical 7-Thoracic 1 vertebral interspace; the upper torso to middle torso pivot is located at a position approximately corresponding to the Thoracic 8 and 9 vertebral interspace and the middle torso to lower torso pivot is located at a position approximately corresponding to the lumbar 3 and 4 vertebral interspace.

3. The device as recited in claim 2 including a shoulder envelope slot in said upper torso member; said upper arm member having an elongated slot extending longitudinally at the upper end thereof; means adjacent said shoulder envelope and said elongated slot for indicating the normal shoulder arm pivot position and arm extended forward position and arm fully extended forward position.

4. The device as recited in claim 2 including means for shortening the torso when the manikin is moved from an erect position to a slumped position; said means for shortening the torso including a pivot pin secured to the upper torso member movable in a slot in the middle torso member to provide relative movement of the pivot with respect to the middle torso member; a guide slot on one of said members having a first curved portion having its center at the upper position of said movable pivot, a second portion having its center at the lower position of said movable pivot and an additional portion interconnecting said first portion and said second portion.

5. The device as recited in claim 4 including a shoulder envelope slot in said upper torso member; said upper arm member having an elongated slot extending longitudinally at the upper end thereof; means adjacent said shoulder envelope and said elongated slot for indicating the normal shoulder arm pivot position and arm extended forward position and arm fully extended forward position.

6. The device as recited in claim 5 wherein said means for restricting movement of the head, the neck, the upper torso member, the middle torso member and the lower torso member to anatomically correct positions includes limit motion stops on said members; said upper leg member including limit motion stops for restricting movement of the upper leg to anatomically correct positions; said foot member including limit motion stops for restricting movement of said foot to anatomically correct positions; said hand member including limit motion stops for restricting movement of the hand to anatomically correct positions; said upper leg member and said lower leg member including limit motion stops for limiting rearward movement of the lower leg member to anatomically correct positions and stop means on said upper arm member for limiting forward movement of the lower arm member to anatomically correct positions; means for indicating the eye position; means for indicating the ear position and means for indicating the position of the carotid sinus; position indicating means adjacent each of the manikin pivots; means on said upper torso member and said middle torso member for substantially tracking the position of the aortic valves.

* * * * *

UNITED STATES PATENT OFFICE

CERTIFICATE OF CORRECTION

PATENT NO. : 4,026,041

DATED : May 31, 1977

INVENTOR(S) : Kenneth W. Kennedy

It is certified that error appears in the above-identified patent and that said Letters Patent are hereby corrected as shown below:

Column 3, line 15, change "tablets" to --- tables ---;

Column 4, line 19, change "simultation" to --- simulation ---;

Column 5, line 38, change " vertical" to --- vertebral ---.

Signed and Sealed this

*Fourth* Day of *October 197*

[SEAL]

*Attest:*

RUTH C. MASON
*Attesting Officer*

LUTRELLE F. PARKER
*Acting Commissioner of Patents and Tradema*